US007539596B2

(12) United States Patent
Zoll et al.

(10) Patent No.: US 7,539,596 B2
(45) Date of Patent: May 26, 2009

(54) DIAGNOSIS AND STATE MONITORING OF JUNCTIONS, CROSSINGS, CROSSROADS OR RAIL JOINTS BY MEANS OF A RAIL VEHICLE

(75) Inventors: Andreas Zoll, Brandenburg (DE); Daniel Lüke, Genthin (DE)

(73) Assignee: Deutsche Bahn AG, Berlin (DE)

( * ) Notice: Subject to any disclaimer, the term of this patent is extended or adjusted under 35 U.S.C. 154(b) by 8 days.

(21) Appl. No.: 11/663,204

(22) PCT Filed: May 4, 2005

(86) PCT No.: PCT/EP2005/004837

§ 371 (c)(1),
(2), (4) Date: Mar. 19, 2007

(87) PCT Pub. No.: WO2006/032307

PCT Pub. Date: Mar. 30, 2006

(65) Prior Publication Data

US 2007/0299630 A1 Dec. 27, 2007

(30) Foreign Application Priority Data

Sep. 20, 2004 (DE) ..... 10 2004 045 457

(51) Int. Cl.
*B61L 23/04* (2006.01)
*G06F 17/00* (2006.01)

(52) U.S. Cl. ..... 702/183; 702/34; 702/35; 702/36; 246/113; 246/120; 246/121

(58) Field of Classification Search ..... 702/183, 702/34, 35, 36, 56

See application file for complete search history.

(56) References Cited

U.S. PATENT DOCUMENTS 5,150,618 A * 9/1992 Bambara ..... 73/660

(Continued)

FOREIGN PATENT DOCUMENTS

DE 195 80 680 T2 9/1996

(Continued)

OTHER PUBLICATIONS

Translation of EP 1236633.*

(Continued)

*Primary Examiner*—Hal D Wachsman
(74) *Attorney, Agent, or Firm*—Collard & Roe, P.C.

(57) ABSTRACT

A method and a device for diagnosis and state monitoring of a wear and functional state of a junction, a crossing, a crossroads, rail joints, and/or track nonuniformities of a rail traffic path made of several tracks measures and stores swing acceleration in at least one direction when overtaking a rail vehicle on a junction, crossings or crossroads, in addition to rail joints or track nonuniformities on at least one rail vehicle component, the swing acceleration being produced on the rail vehicle component when overtaking the rail vehicle at the junction, crossing or crossroads, rail joints, track nonuniformites. The method also measures and stores the rail vehicle speed and determines and stores the travel direction and the place of the junction, crossing or crossroads, rail joints, track nonuniformities, carries out a control as to whether characteristic, predetermined threshold values of the measured swing accelerations have been exceeded.

4 Claims, 2 Drawing Sheets

U.S. PATENT DOCUMENTS

| | | | | |
|---|---|---|---|---|
| 5,579,013 | A * | 11/1996 | Hershey et al. | 342/357.06 |
| 5,786,750 | A * | 7/1998 | Cooper | 340/425.5 |
| 5,867,404 | A * | 2/1999 | Bryan | 714/724 |
| 5,956,664 | A * | 9/1999 | Bryan | 702/184 |
| 6,668,239 | B1 * | 12/2003 | Gilbert et al. | 702/188 |
| 6,672,681 | B1 * | 1/2004 | Moretti et al. | 301/109 |
| 7,184,930 | B2 * | 2/2007 | Miyasaka et al. | 702/183 |
| 2002/0056398 | A1 * | 5/2002 | Bachtiger et al. | 105/157.1 |
| 2004/0140405 | A1 * | 7/2004 | Meyer | 246/122 R |
| 2006/0076461 | A1 * | 4/2006 | DeRose et al. | 246/122 R |
| 2007/0203621 | A1 * | 8/2007 | Haugen et al. | 701/19 |

FOREIGN PATENT DOCUMENTS

| | | |
|---|---|---|
| DE | 198 27 271 | 12/1999 |
| DE | 10 2004 014 282 | 10/2005 |
| DE | BN 821.2005 | 4/2008 |
| EP | 1 236 633 A | 9/2002 |

OTHER PUBLICATIONS

International Search Report.

* cited by examiner

DIAGNOSIS AND STATE MONITORING OF JUNCTIONS, CROSSINGS, CROSSROADS OR RAIL JOINTS BY MEANS OF A RAIL VEHICLE

CROSS REFERENCE TO RELATED APPLICATIONS

Applicants claim priority under 35 U.S.C. §119 of German Application No. 10 2004 045 457.4 filed Sep. 20, 2004. Applicants also claim priority under 35 U.S.C. §365 of PCT/EP2005/004837 filed May 4, 2005. The international application under PCT article 21(2) was not published in English.

BACKGROUND OF THE INVENTION

1. Field of the Invention

This application is the National Stage of PCT/EP2005/004837 filed May 4, 2005, which claims priority under 35 U.S.C. §119 of German Application No. 10 2004 045 457.4 filed Sep. 20, 2004. The international application under PCT article 21(2) was not published in English.

DESCRIPTION

The invention relates to a method and to a device for the diagnosis and state monitoring of wear and functional state of a junction and/or a crossing and/or a crossroads and/or rail joints and/or track nonuniformities of a rail traffic path which is made up of several tracks.

2. Description of the Related Art

Junctions, crossings and crossroads bring together several rail traffic tracks into one track, combining these with one another or, in the case of a crossing, pass one track through another track. Unobstructed and almost stable tracking of a wheel of a rail vehicle rolling over a junction, crossing or crossroads is guaranteed by a so-called frog, which is situated at a point of intersection of the crossing tracks. Here, rigid and moveable frogs are distinguished. In the case of a rigid frog, a planned interruption of an inner side of a rail head is present at the point of intersection, the so-called frog gap. This frog gap causes the wheel to travel over a groove while rolling over the junction, crossing or crossroads, resulting in shock-like vibrations and loads to occur both on the wheel and on the rigid frog. In the long term this results in increased wear of the rigid frog and the entire junction, crossing or crossroads. To solve this problem a moveable frog is used on junctions, crossings or crossroads used by trains with higher speeds, a moveable frog is used, which for the respective track, establishes a continuous inner edge of the rail head. The predominant number of junctions, crossings or crossroads however has a rigid frog for reasons of reduced manufacturing and maintenance costs and restricted installation space.

The measurements to establish the wear and functional state of junctions, crossings or crossroads are personnel-intensive and are often, from a material point of view, performed too infrequently and/or too late so that more preferably measuring of frogs after scheduled inspections takes place only once these are already conspicuous. Visual estimations during scheduled inspections can only inadequately describe the actual wear of junctions, crossings or crossroads.

As prior art it is known that diagnosis of junctions, frogs and crossings is performed through visual assessment and evaluation according to methods of the internal rail regulation DS 820.06 05 B5 and standard BN 821.2005. These are manual measuring methods with straight edges, gauges, measuring lines, measuring wedges, mirrors and feeler gauges.

More preferably, ramp courses are established on the frog, flatness and direction of the rails checked as well as vertical position of the frog and the wing rails established. To this end, expenditure in terms of personnel of three persons, expenditure in terms of time of up to approximately half an hour and an 8-part measuring equipment set in part using up a lot of space are required.

In addition, merely geometrical data on the wear state on the frog and wing rail at the time of measurement are available as a result without further statements on the relevant permanent way and sub-structures. Likewise, hollow sleeper positions are not recognized and to date not detected with any system.

The disadvantage of this solution therefore is more preferably a major measuring effort in terms of personnel and time, i.e. infrequent and only inadequate description of the actual wear and functional state. Predicting and initiating timely maintenance dates are therefore hardly possible. Intervention threshold values more preferably for the overflow area are absent to date.

From DE 10 2004 014 282 a method and a device for the diagnosis and state monitoring in the overflow area of a junction, a crossing or a crossroads of a rail traffic path are known. Here, vibration accelerations of the frog or the crossing point are measured on the rigid frog or the crossing point on at least one location of the frog or crossing point in at least a three-dimensional direction which are generated by the passing of a vehicle over the frog/the crossing point. With this method the wear of components is therefore determined directly on the relevant components of the junction, crossing or crossroads. If it is intended to examine several different junctions, crossings or crossroads in succession, the relevant measuring device has to be disassembled through measuring personnel at the one junction, crossing or crossroads, transported to the next junction, crossing or crossroads and assembled there. Diagnosis of several different junctions, crossings or crossroads in succession therefore involves greater effort in terms of time and personnel.

A mobile tracking unit for detecting defective states in rail vehicles and track paths is known from DE 195 80 680 T2. A mobile tracking unit comprises a rotation measuring unit to determine the rotational speed of a wheel set, a movement sensor more preferably in form of an acceleration pickup, a data processor, a navigation set as well as a transmitter for transmitting established data to an evaluation centre. However, the disadvantage here is that a special mobile tracking unit is required for detecting defective states, i.e. a special vehicle that has to track a rail vehicle.

SUMMARY OF THE INVENTION

It is thus the object of the invention to provide a method and a device by means of which with little effort an evaluation of the overall system junction, crossing or crossroads as well as rail joints and track nonuniformities can be carried out even prior to becoming conspicuous without having the disadvantages of the prior art.

This object is solved by the method and the device according to the invention. In one aspect, a method is provided for the diagnosis and state monitoring of a junction and/or a crossing and/or a crossroads as well as of rail joints and track nonuniformities of a rail traffic path. Here, when a rail vehicle passes over the junction, crossing or crossroads as well as rail joints or track nonuniformities, vibration accelerations on at least a component of the rail vehicle are measured and saved in at least a three-dimensional direction which are generated on, the component of the rail vehicle through the passing of the rail vehicle over the junction, crossing or crossroads as well as rail joints and track nonuniformities.

According to the invention, more preferably vibration accelerations on passing over of a rail vehicle are thus measured and evaluated true to the location. These are directly connected with the wear and functional state of the junction, crossing or crossroads, rail joint and track nonuniformities since increasing vibration accelerations are more preferably caused through growing deviations of their geometry from its required shape and its position from its required position. More preferably, rolling of a railway wheel over the frog gap in the case of rigid frogs consequently takes place increasingly "less gentle" with increasing wear. At the same time, high vibration accelerations mean high rates of energy introduction into individual components of the junction, crossing or crossroads as well as the rail joint and track nonuniformities which additionally promote and accelerate advancing of the wear. Rolling over instabilities of the junction, crossing or cross roads, the rail joint and track nonuniformities due to the design, together with their increasing wear or poor setting creates characteristically changing values of vibration acceleration on a wheel or wheel set of the vehicle rolling over. These vibration accelerations spread to the entire vehicle in accordance with dampings of the design of the vehicle caused by the design. In this way, growing deviations of the geometry from settings and attachments of components of the junction, crossing or crossroads as well as the rail joint and track nonuniformities create increasing vibration accelerations in the vehicle and vice versa.

According to the invention, the speed of the rail vehicle is first measured and saved and the travel direction and the location of the junction, crossing or crossroads as well as the rail joint and track nonuniformities are determined and saved.

Technical signal pre-processing of the measurement signals on board the vehicle is advantageously conducted thereafter so that only extracted data such as travel direction, wheel set accelerations, traveling speed, local position of the train have to be transmitted via interfaces of the vehicle. By a data acquisition system arranged in the rail vehicle, the measured and stored signals of the at least one acceleration sensor, the speed measuring device and the locating device are processed and evaluated. Maintenance deadlines and the corresponding maintenance efforts are forecast.

In addition to this, a control is carried out as to whether characteristic, predetermined threshold values of the measured swing accelerations have been exceeded. In the event that prescribed limit values of the vibration acceleration are exceeded, follow-up more extensive measurement of a condition of components of the junction, crossing or crossroads more preferably according to the regulations DS 820 06 05 B5 and BN 821.2005 is initiated.

Measurement of the vibration acceleration is particularly advantageously performed with the help of acceleration sensors which are preferably provided in the proximity of the contact point of wheel and rails, more preferably on a wheel set bearing cap or as closely as possible to the wheel-rail contact point, more preferably of a measuring wheel set specially selected for this purpose.

Preferably, to determine the local position of the train, a satellite-supported position indicating device is advantageously used, more preferably GPS, DGPS or Gallileo. In this way, position indicator is advantageously possible also on routes that do not have train control systems which inform the rail vehicle of its position on the route.

In another aspect, a device is provided to carry out the method according to the invention.

When a rail vehicle travels over the junction, crossing or crossroads, the rail joint or the track discontinuity with a certain speed and in a certain travel direction at least an acceleration sensor determines on at least a component of the rail vehicle a vibration acceleration created by the rail vehicle through traveling over the frog or the instability. The acceleration sensors determine the vibration acceleration either merely in a three dimensional direction or particularly preferably in several, more preferably all three three-dimensional directions perpendicular to one another. In addition, special acceleration sensors can also be used to determine rotary and/or yawing movements on at least a component of the rail vehicle.

Here, more preferably piezoelectric acceleration pickups are used as acceleration sensors. These are characterized by low weight, compact design and their robustness and long life.

A speed measuring device determines the speed of the rail vehicle. Here, a speed measuring device present in the rail vehicle is more preferably used which also indicates the speed to the vehicle driver. Alternatively, use of radar, ultrasound or laser measuring devices is more preferably possible.

A positioning device determines the location of the measured junction, crossing or crossroads as well as rail joints and track nonuniformities so that local assignment of the determined vibration accelerations to the corresponding measured junction, crossing or cross roads, rail joint and track nonuniformity can take place. Advantageous in this context is that upon occurrence of irregularities or exceeding of characteristic prescribed limit values of the vibration acceleration, maintenance personnel can be accurately directed to the respective conspicuous junction, crossing or crossroads, rail junction and track nonuniformity. As positioning device, a position indicator of the rail vehicle present in the rail vehicle is advantageously used in connection with the position of the acceleration pickup within the rail vehicle. This position indicator of the rail vehicle is performed more preferably by way of train control systems of the route travelled which inform the rail vehicle of its position on the route, more preferably a scheduled train influencing system (LZB) or a European Train Control System (ETCS), or by way of a satellite supported position indicating device.

Particularly advantageously a positioning device is used which in addition to a position indicator also provides an indication of the speed and the travel direction of the rail vehicle as is more preferably possible with a satellite supported position indicating device. As a result, the speed measuring device and the positioning device are combined into a single device so that a separate speed measuring device is no longer required.

A data acquisition system processes the measured signals of the acceleration sensors, the speed measuring device and the positioning device, saves them more preferably electronically or magnetically and evaluates them accordingly. In the process, the data acquisition system forecasts maintenance deadlines and the corresponding maintenance efforts. In addition, the data acquisition system checks if characteristic prescribed limit values are exceeded. If prescribed limit values are exceeded, follow-up more comprehensive measurement of the state of the junction, crossing or crossroads more preferably according to the regulations DS 820 06 05 B5 and BN 821.2005 is initiated with the help of the data acquisition. Consequently a supportive utilization of conventional means of measurement is only required if the device according to the invention detects a "maintenance requirement" or such is demanded by the regulatory works.

Advantages of the method according to the invention and the device according to the invention more preferably are in the diagnosis and state monitoring of a junction, crossing or crossroads, rail joint and track nonuniformities between scheduled inspections or maintenance operations. Here, a first more accurate statement on the state of the junction, crossing or crossroads is made through a rapid and simple check. Thus, particularly timely, wear is detected and from its data a necessary maintenance date and maintenance effort forecast, as a result of which more preferably better medium term planning and optimization of the life cycle costs is guaranteed. In addition comparability with earlier measured values is possible.

Particularly advantageously

No personnel and no time expenditure is required through the invention more preferably with a fully automatic measuring and evaluation process, Current automatic trend analyses are made possible through the invention, An inspection effort can be adapted, optimised and reduced on location through the invention A travelling comfort for passengers is increased through the invention, Sound emissions can be lowered.

It is intended that suitably equipped regular trains with commercially available wheel sets can also take over this measuring task (with appropriate consideration of signalling equipment).

BRIEF DESCRIPTION OF THE DRAWINGS

The invention is explained in more detail in the following by means of an exemplary embodiment and drawings. The drawings show in FIG. 1 schematically a rail vehicle with a measuring device according to the invention passing over an instability of a rail.

DETAILED DESCRIPTION OF PREFERRED EMBODIMENTS

Figure 1:
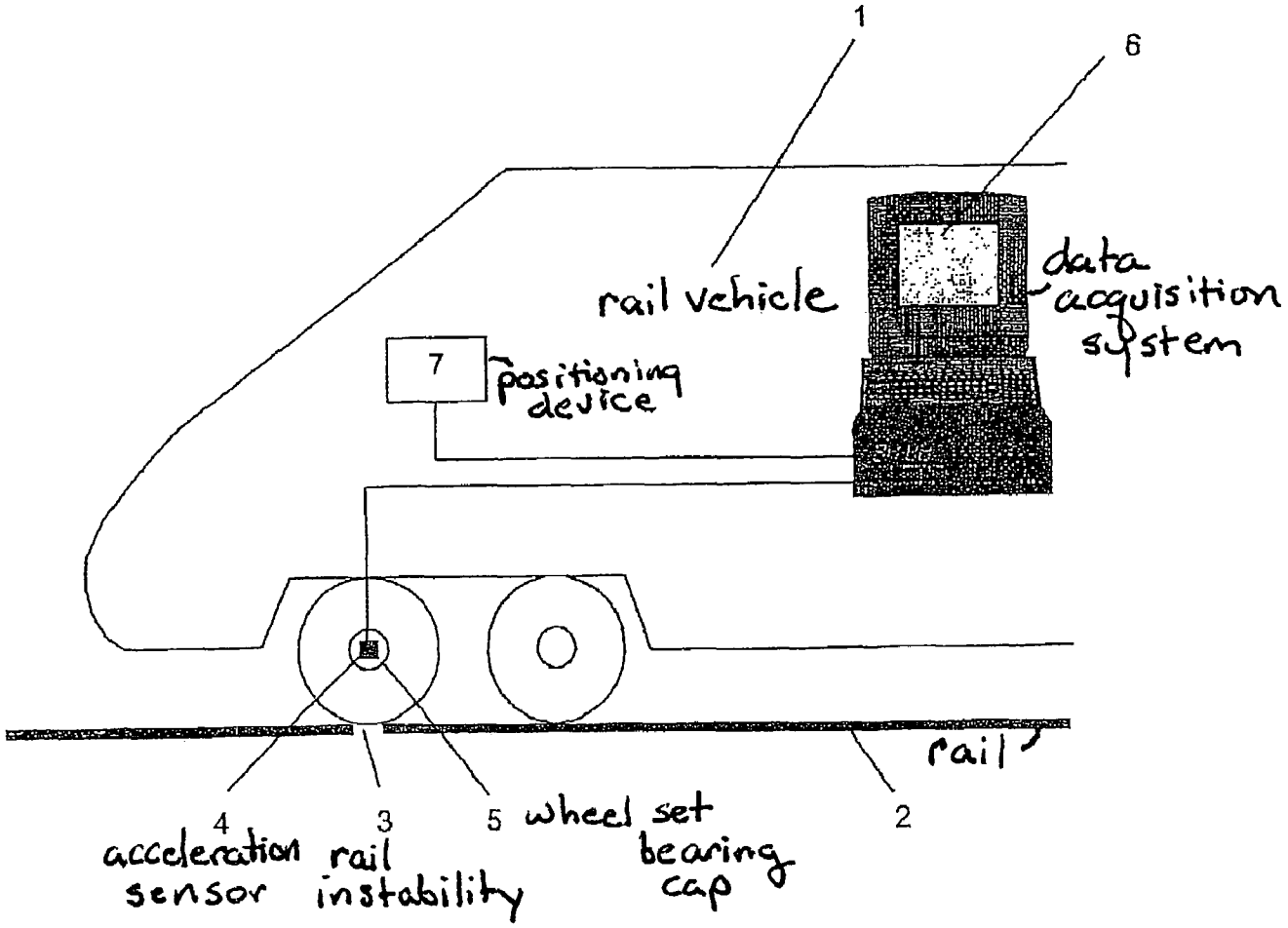

A particularly advantageous exemplary embodiment relates according to FIG. 1 to a rail vehicle 1 travelling over an instability 3 of a rail 2. The instability 3 of the rail 2 in this case presents an example of a frog gap of a junction with a rigid frog.

Figure 2:
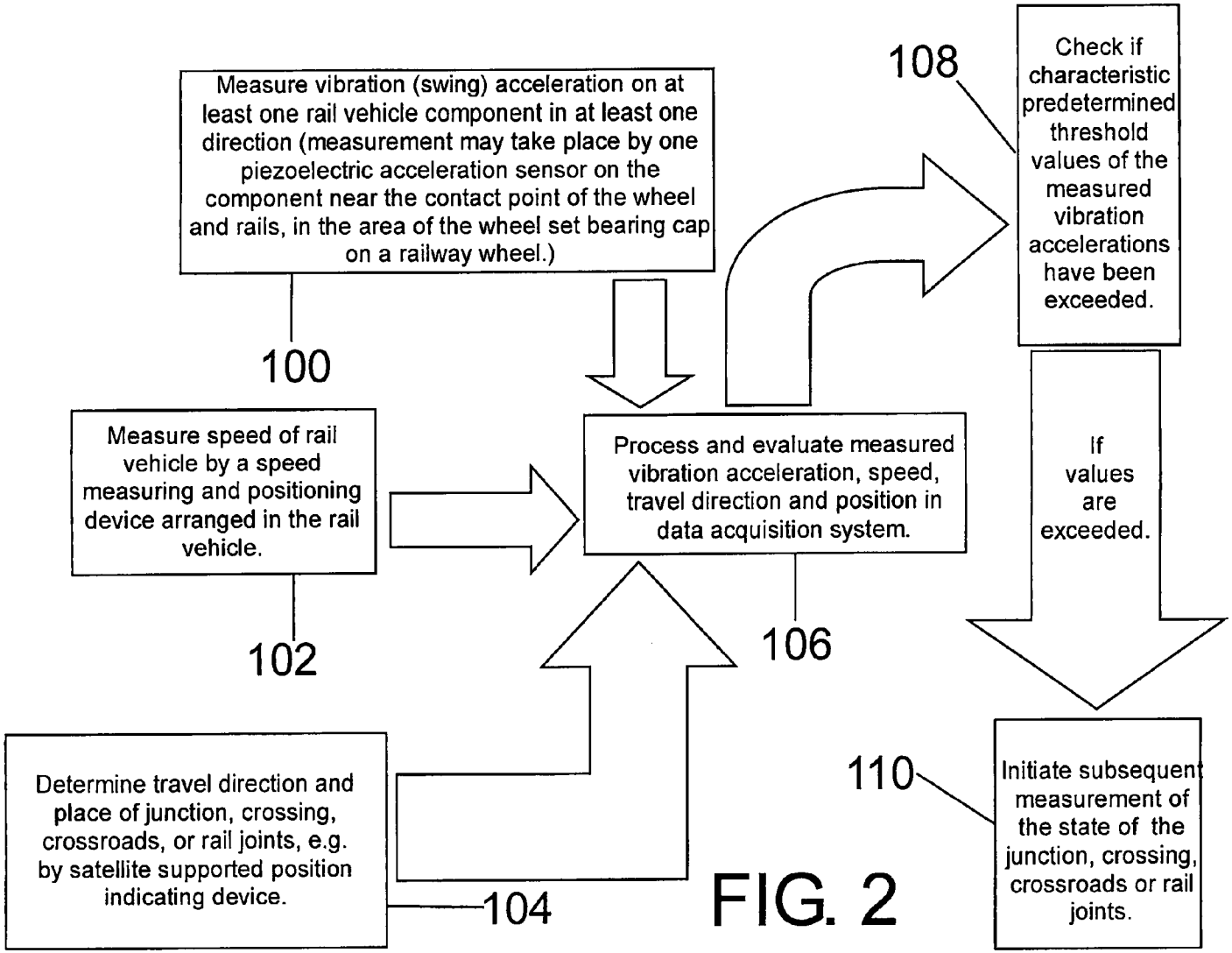
FIG. 2 a flow chart setting forth the steps of the method in accordance with an embodiment of the invention.

When the rail vehicle travels over the instability 3 with a certain speed and a certain travel direction an acceleration sensor 4, provided on a wheel set bearing cap 5 (or as closely as possible to the contact point proximity of wheel and rails) determines vibration accelerations to which the rail vehicle is subjected as a result of the travelling over. See FIG. 2, step 100. In addition, a positioning device 7, more preferably a satellite supported position indicating device, establishes the position, the speed and the travel direction of the rail vehicle. See FIG. 2, steps 102 and 104.

A data acquisition system 6 performs signal processing and signal storage of the measurement signals of the acceleration sensor 4 and the positioning device 7 and evaluates them accordingly. See FIG. 2, step 106. Moreover, the data acquisition system 6 checks if characteristic prescribed limit values, of the vibration acceleration are exceeded. See FIG. 2, step 108. If the prescribed limit values are exceeded, the data acquisition system 6 initiates a follow-up more comprehensive measurement of a position and a state of components of the junction, more preferably according to the regulations DS 820 06 05 B5 and BN 821.2005. See FIG. 2, step 110. As a result, worn components established are maintained and renewed checking according to the invention is carried out by means of which a quality of a component maintenance is verified and checked.

LIST OF REFERENCE NUMBERS

1 rail vehicle
2 rail
3 instability of the rail
4 acceleration sensor
5 wheel set bearing cap
6 data acquisition system
7 positioning device

The invention claimed is:

1. A method for diagnosis and state monitoring of a wear and functional state of a junction, a crossing, a crossroads, or rail joints of a rail traffic path made of several tracks, wherein the method comprises the steps of:

measuring and storing swing acceleration of at least one rail vehicle component of a rail vehicle in at least one direction by means mounted onboard of the rail vehicle, the swing acceleration being produced on the at least one rail vehicle component with the rail vehicle passing at the junction, crossing, crossroads or rail joints, measuring and storing the rail vehicle speed and determining and storing the travel direction, as well as place of the junction, crossing, crossroads or rail joints through a satellite supported position indication device, processing and evaluating by means mounted onboard of the rail vehicle the measured swing acceleration, rail vehicle speed, travel direction and positions in order to forecast maintenance deadlines and the corresponding maintenance efforts, carrying out a control as to whether characteristic, predetermined threshold values of the measured swing accelerations have been exceeded and a subsequent further measurement of the state of the junction, crossing, crossroads or rail joints, if the predetermined threshold values of the swing acceleration have been exceeded.

2. The method for diagnosis and state monitoring according to claim 1, wherein the measurement of swing accelerations is performed in the proximity of the contact point of wheel and rails.

3. The method for the diagnosis and state monitoring according to claim 2, wherein the measurement of swing accelerations is performed in the area of a wheel set bearing cap of the rail vehicle.

4. The method for the diagnosis and state monitoring according to claim 1, wherein the measurement of swing accelerations is performed on a railway wheel in the area of a wheel-rail contact point.

* * * * *